US007622375B2

(12) United States Patent
Kisu et al.

(10) Patent No.: US 7,622,375 B2
(45) Date of Patent: Nov. 24, 2009

(54) CONDUCTIVE MEMBER AND PROCESS OF PRODUCING THE SAME

(75) Inventors: Hiroki Kisu, Huntington Beach, CA (US); Keiichi Murai, Tokyo (JP); Naotoshi Miyamachi, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 372 days.

(21) Appl. No.: 10/509,698

(22) PCT Filed: Mar. 28, 2003

(86) PCT No.: PCT/JP03/04007

§ 371 (c)(1),
(2), (4) Date: Jun. 9, 2005

(87) PCT Pub. No.: WO03/083172

PCT Pub. Date: Oct. 9, 2003

(65) Prior Publication Data

US 2005/0233065 A1 Oct. 20, 2005

(30) Foreign Application Priority Data

Apr. 1, 2002 (JP) ..... 2002-098299

(51) Int. Cl.
*H01L 21/20* (2006.01)

(52) U.S. Cl. ..... 438/584; 257/E21.011; 257/E21.161; 257/E21.168; 257/E21.585; 438/597; 438/598

(58) Field of Classification Search ..... 257/E21.011, 257/E21.161, E21.168, E21.58; 438/584, 438/597, 598

See application file for complete search history.

(56) References Cited

U.S. PATENT DOCUMENTS

| | | | | |
|---|---|---|---|---|
| 6,197,387 | B1 * | 3/2001 | Fiedler et al. | 427/532 |
| 6,730,400 | B1 * | 5/2004 | Komatsu et al. | 428/403 |
| 2007/0087564 | A1 * | 4/2007 | Speakman | 438/674 |

FOREIGN PATENT DOCUMENTS

| | | | |
|---|---|---|---|
| JP | 2000/318308 | | 11/2000 |
| JP | 2001-167647 | | 6/2001 |
| JP | 2001/234356 | | 8/2001 |
| JP | 2003-013242 | | 1/2003 |
| WO | WO 9901766 | * | 1/1999 |

* cited by examiner

*Primary Examiner*—Asok K Sarkar
(74) *Attorney, Agent, or Firm*—Fitzpatrick, Cella, Harper & Scinto

(57) ABSTRACT

Provided are a method of manufacturing an electrically conductive member having excellent properties and such electrically conductive member. A method of manufacturing an electrically conductive member having an electrically conductive film on a surface of a substrate, comprising the steps of: (i) forming a layer containing a colloid on a porous surface of a substrate having at least the porous surface by applying a colloidal solution and (ii) forming an electrically conductive layer by drying the layer containing the colloid.

8 Claims, 6 Drawing Sheets

CONDUCTIVE MEMBER AND PROCESS OF PRODUCING THE SAME

TECHNICAL FIELD

The present invention relates to a method of manufacturing an electrically conductive member in which an electrically conductive film is formed from a liquid phase, specifically, an electrically conductive member having an electrically conductive metal member or the like capable of being used in wirings and terminals and an electrically conductive member such as an organic semiconductor element having excellent electrical conductivity, and an electrically conductive member obtained by this method.

BACKGROUND ART

The vacuum processes such as, for example, the vacuum deposition method, the chemical vapor deposition (CVD) method, the sputtering method and the like have hitherto been adopted as methods of forming various functional films (thin films such as an electrically conductive film and an insulating film) in electronic devices such as semiconductor devices. Because it is necessary to form a vacuum in these processes, equipment becomes large in size and this often provides complicatedness. Therefore, there is a need for a simpler high-performance process for forming thin films.

Furthermore, Japanese Patent Application Laid-Open No. 2001-234356 discloses a method by which a colloidal layer is formed on a substrate, and an electrically conductive film excellent in electrical conductivity is produced on the colloidal layer by irradiation with energy rays that provide a larger absorption intensity in the colloidal layer than in the substrate. An embodiment of the method involves adding an aqueous solution of silver colloids on a glass substrate and applying the solution by the spin-coating method. However, according to an examination by the present inventors, the adhesion between an electrically conductive film that is first obtained and the substrate is not sufficient and the inventors have recognized that in consideration of device applications of the electrically conductive film, it is necessary to improve the adhesion between the electrically conductive layer and the substrate. Also, the same official gazette describes that a colloidal solution is applied to a substrate by use of an inkjet recording head. However, according to an examination by the present inventors, it was very difficult to form fine electrically conductive patters on a substrate by using the technique described in this official gazette.

Therefore, the object of the present invention is to provide a method of manufacturing an electrically conductive member having a film (thin film) with good properties by a simple apparatus and process and an electrically conductive member having a film with good properties.

DISCLOSURE OF THE INVENTION

The above-described object is achieved by the present invention, which will be described below. That is, the invention provides a method of manufacturing an electrically conductive member having an electrically conductive film on a surface of a substrate, which is characterized in that the method includes (i) the step of forming a layer containing a colloid on a porous surface of a substrate having at least the porous surface by applying a colloidal solution and (ii) the step of forming an electrically conductive layer by drying the layer containing the colloid.

In the invention described above, it is preferred that the colloid be a metal colloid, that the metal be silver, gold, platinum or palladium, that the method includes the step of forming a layer containing the colloid by applying the colloidal solution to the porous surface by the spin-coating method, that the method includes the step of forming a layer containing the colloid on the porous surface in a position-selective manner, that a layer containing the colloid be formed in a position-selective manner by applying the colloidal solution to the porous surface by the inkjet method, and that vicinities of the porous surface, including the surface, have a pseudo-behmite structure.

In the invention described above, there is provided a method of manufacturing an electrically conductive member, which is characterized in that the following condition is satisfied when it is assumed that an average particle diameter of the metal colloid is $\phi 1$ ave and that an average pore diameter of the porous surface is $\phi 2$ ave:

$$\phi 1 \text{ ave} \geqq \phi 2 \text{ ave}.$$

Also, the invention provides an electrically conductive member manufactured by a method of the invention, i.e., an electrically conductive member having an electrically conductive film on a porous surface of a substrate, which is characterized in that the electrically conductive film is a dried film of a wet applied film containing colloidal particles, and the electrically conductive member in the electrically conductive member may have portions in contact with an organic semiconductor.

The present inventors have recognized that the above-described problem can be solved by the following measures:

1: By applying, absorbing and drying a metal colloidal solution, an organic substance that is originally present in the periphery of metal colloidal particles is removed, whereby a metal particle-metal particle contact is formed.

2: By providing a porous absorption layer on a substrate, the holding of metal colloidal particles is ensured and a highly fine pattern is formed.

BEST MODE FOR CARRYING OUT THE INVENTION

The present invention will be described in further detail below by giving a preferred mode for carrying out the invention.

(Method of Manufacturing an Electrically Conductive Member)

A method of manufacturing an electrically conductive member according to the invention will be described in detail below. A method of manufacturing an electrically conductive member according to the invention includes the process of forming a layer containing a colloid by applying a colloidal solution to a porous surface of a substrate, which is followed by forming an electrically conductive member by drying the layer containing the colloid. According to this method, an electrically conductive member having a film with good electrical conductivity can be obtained without using large-size equipment and complicated processes. And in the invention, an electrically conductive member that is excellent particularly in electrical conductivity and has an electrically conductive film of fine patterns can be manufactured at low cost particularly by using a metal colloid as the above-described colloid.

Figure 1:
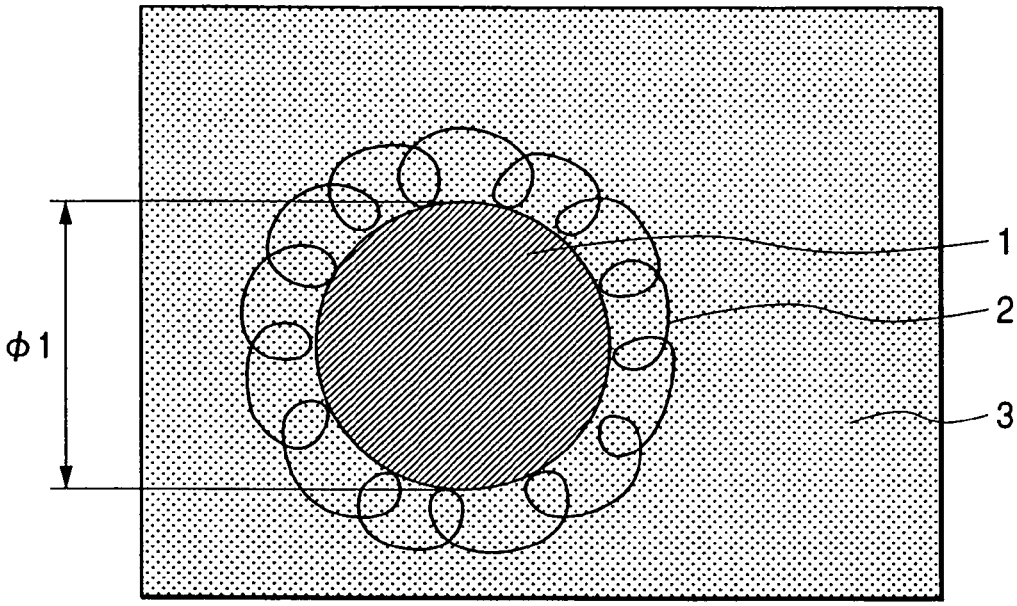
FIG. 1 shows how an organic substance adheres to the periphery of a metal colloidal particle.

An example of a method of manufacturing an electrically conductive member that involves using a solution of the above-described metal colloid will be described below as a preferred mode for carrying out a method of manufacturing an electrically conductive member according to the invention. In a metal colloidal solution, generally, an organic substance 2 adheres to the periphery of a metal colloidal particle 1 in order to stabilize the colloidal particle, as shown in FIG. 1. Citric acid, PVP (poly(N-vinyl-2-pyrrolidone)), MMS-NVP (mercaptomethylstyrene-N-vinyl-2-pyrrodidone) copolymers, polyacrylonitrile, etc. are enumerated as examples of the organic substance 2. The numeral 3 denotes a liquid medium to disperse the metal colloidal particle 1 and can be selected from substances ranging from organic solvents to water.

Figure 2:
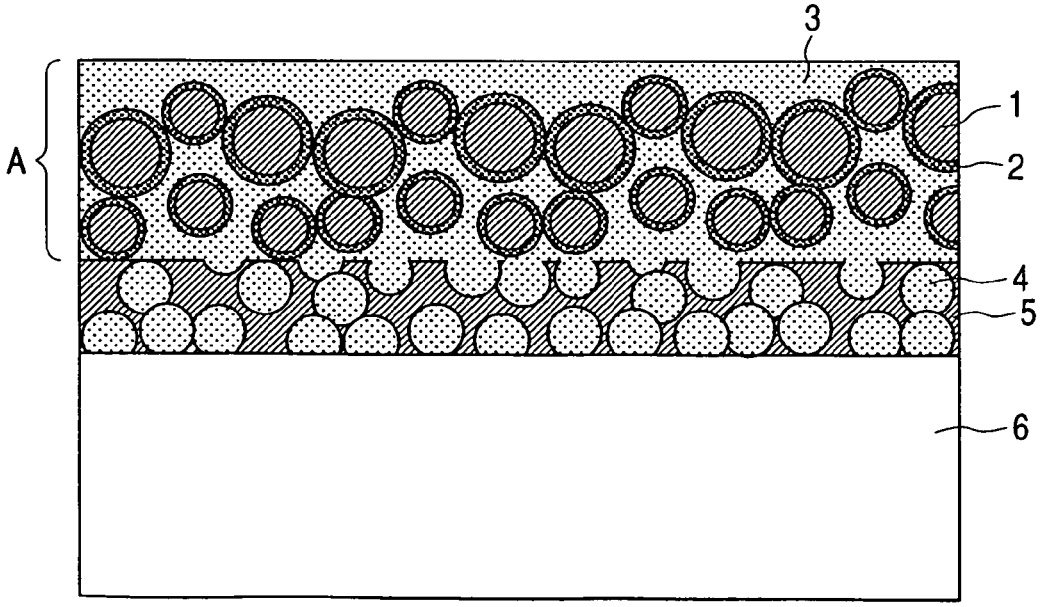
FIG. 2 shows how a metal colloidal solution is applied to a porous surface.
Figure 3:
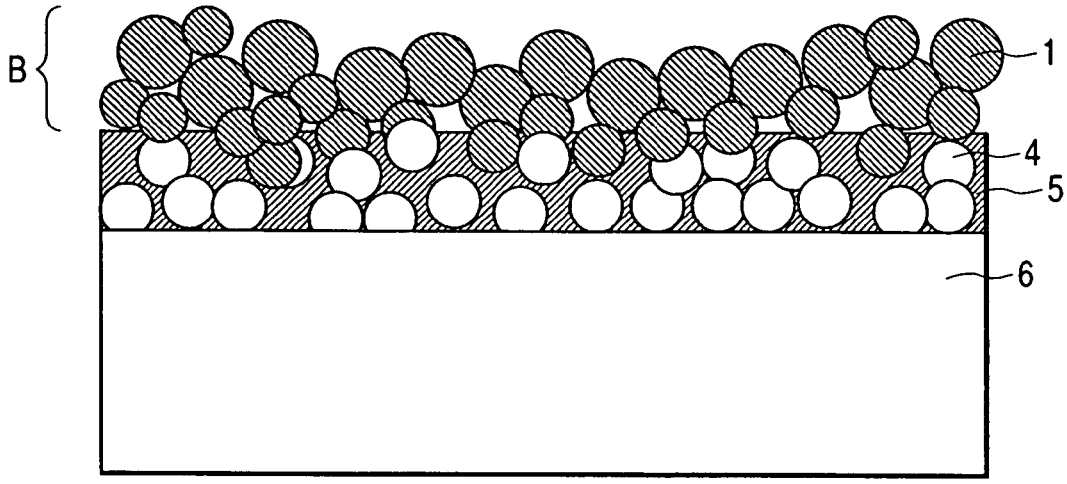
FIG. 3 shows how an organic substance and a medium are removed.

In this mode of embodiment, when a metal colloidal solution is applied to a porous metal of a substrate 6, as shown in FIG. 2, the condition of a layer A containing the metal colloid (which layer is untreated, i.e., before drying, which will be described later) is such that on the porous surface 5, the metal colloidal particle 1 is separated from the solvent 3 due to the absorption of the liquid medium by the porous surface. And by the drying of the liquid medium in the layer A containing the metal colloid in this state and by the absorption of the liquid medium by the porous surface, the organic substance 2 and the liquid medium 3 in the layer A containing the metal colloid are removed and after the drying, as shown in FIG. 3, it is possible to form a layer B in which a strong contact state is generated between the metal colloidal particles 1. The numeral 6 denotes a substrate that is formed from, for example, PET (polyethylene terephthalate) or paper.

FIG. 3 schematically shows how the layer B in which strong contact is generated between the metal colloidal particles 1 is formed. In FIG. 3, the organic substance 2 and the liquid medium 3 are removed by absorption and drying, and metal colloidal particles 1 having small particle diameters move into holes 4 of the porous surface 5 and are combined with the metal colloidal particles 1 on the porous surface 5. As a result, a strong anchor effect works between the layer B and the porous surface 5, thereby making it possible to very efficiently suppress the exfoliation of the layer B from the porous surface 5. In other words, the adhesion between the layer B and the porous surface 5 can be improved.

The above-described method provides the excellent advantage that an electrically conductive member having the electrically conductive film B with high electrical conductivity and excellent adhesion to the porous surface 5 is obtained. Also, in this mode of embodiment, the above-described removal of an organic substance and a medium by absorption and drying can be simultaneously performed and, therefore, a desired electrically conductive film can be formed on the substrate surface without exercising an effect on the substrate to be treated.

Irradiation with hot air, near-infrared rays, infrared rays, far-infrared rays and the like can be enumerated as drying methods. For example, a drying furnace, an oven, a xenon lamp, a halogen lamp, a mercury lamp or each of these lamps to which a filter is attached, etc. can be enumerated as an apparatus that dries the surface of the layer containing a metal colloid. However, an oven is especially preferable.

The formation of a layer containing a metal colloid on the substrate is performed by applying a colloidal solution in which the metal colloid is dispersed in a liquid medium to the porous surface 5 by use of commonly used methods, for example, the spin-coating method, methods that involve using an inkjet recording head, film forming methods by dipping and the blade coating method. Particularly, it is preferred that this be performed by the spin-coating method or film forming methods that involve using an inkjet recording head.

In this mode of embodiment, an electrically conductive film is formed by the application of a colloidal solution to the porous surface and by the drying of a layer containing the colloid that is formed as a result of this application and, therefore, it is possible to use various wide-ranging metals as the material for the colloid. Therefore, metals capable of being used in the above-described metal colloid are not especially limited and for example, silver, gold, platinum, palladium, nickel, etc. can be enumerated. Among others, silver, gold, platinum and palladium are preferable in terms of stability. Although the thickness of the above-described metal colloidal layer is not especially limited, this thickness is usually 0.1 to 5 μm, preferably 0.5 to 2 μm.

For example, a glass substrate, a polymer substrate of polyaniline, polyester, etc., and flexible materials of paper, PET, etc. can be enumerated as the substrate for forming a layer containing the above-described metal colloid, which is used in this mode of embodiment. And by forming a porous layer containing, for example, an alumina hydrate having a pseudobehmite structure on a substrate of these materials, as will be described later, the porous surface is provided. A method of manufacturing a porous layer containing an alumina hydrate having a pseudobehmite structure is described in detail, for example, in Japanese Patent Application Laid-Open No. 2000-318308.

In the invention, by applying a colloidal solution to the substrate having a porous surface in this manner, the adhesion to the substrate of an electrically conductive film can be greatly improved by the above-described anchor effect between the electrically conductive film and the substrate. Furthermore, because the liquid medium in the colloidal solution is absorbed into the porous surface, even in a case where the colloidal solution is applied in a fine pattern by use of liquid droplet application means, such as an inkjet recording head, the liquid droplets will not spread in a disorderly manner on the substrate. As a result, an electrically conductive member having a fine conductive pattern can be obtained even when the substrate surface is not subjected to a water-repellent treatment in a pattern form or pretreatment, such as water-attracting treatment.

According to a manufacturing method of this mode of embodiment, an electrically conductive member having an electrically conductive metal film excellent in electrical conductivity can be obtained easily and at low cost.

Furthermore, a method of manufacturing an electrically conductive member according to the invention is not limited to the above-described preferred mode of embodiment, and it is also possible to adopt a method of manufacturing an electrically conductive member having a film (thin film) with good properties, such as a semiconductor film, by using as a colloid layer, for example, a semiconductor colloidal layer of cadmium selenide, cadmium sulfide and titanium oxide in place of the above-described metal colloidal layer.

(Electrically Conductive Metal Film)

An electrically conductive member having an electrically conductive metal film obtained by a manufacturing method as described above can be mentioned as a preferred mode of embodiment of an electrically conductive member according to the invention. In the electrically conductive film of an electrically conductive member of this mode of embodiment, the particle diameter of metal colloidal particles that constitute the electrically conductive film is 5 to 1000 nm, particularly 200 to 500 nm or so.

The thickness of the electrically conductive film of an electrically conductive member of this mode of embodiment, which is not especially limited, is 0.1 to 5 μm, particularly 0.5 to 2 μm or so. Furthermore, the thickness of a porous absorption layer is about 30 μm.

The electrically conductive member having an electrically conductive film of this mode of embodiment can be used in applications such as a hydrogen storage device, in addition to wirings and terminals, for example. In particular, the electrically conductive member having an electrically conductive film of the mode of embodiment can be advantageously used mainly in wirings and terminals because of its excellent electrical conductivity as described above.

Furthermore, the film of the electrically conductive member of the invention is not limited to the electrically conductive film as the preferred mode of embodiment described above and can be provided in forms of other functional thin films. This film of the electrically conductive member can be used in applications, such as an organic semiconductor element and functional thin films of other functional devices, for example.

EMBODIMENTS

A method of manufacturing an electrically conductive member of the invention and an electrically conductive member manufactured by this method will be described in further detail below by way of embodiments. However, the invention will not be limited in any way by these embodiments.

Embodiment 1

In a case where it is assumed that the diameter of a silver colloidal particle protected by an organic substance 2 as shown in FIG. 1 is $\phi 1$ ave and that an average particle diameter of the silver colloidal particle is $\phi 1$ ave, in this embodiment $\phi 1$ ave was 10 nm when the particle diameter was measured by use of a particle size distribution measuring machine made by MicroTrack, Inc.

Figure 4:
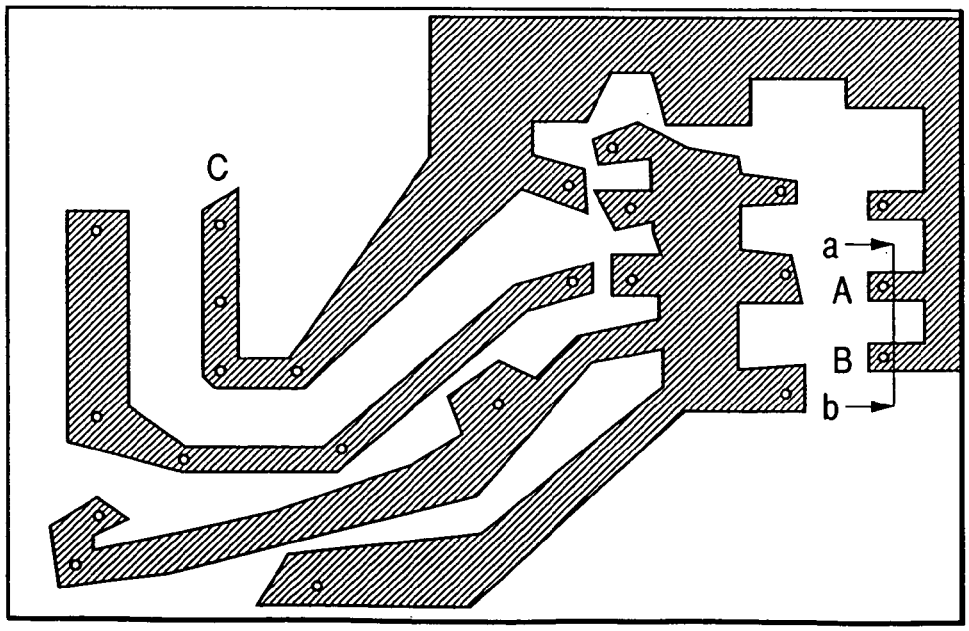
FIG. 4 shows an electric circuit pattern.

Next, a silver colloidal solution was injected into an empty ink tank of an inkjet printer "BJC 600" made by Canon Inc. and the electric circuit pattern shown in FIG. 4 was printed on a sheet of A4 size gloss paper "PR101". Subsequently, the gloss paper was dried at 150° C. for 30 minutes by use of an oven to fix the pattern. This gloss paper has a porous ink receiving layer containing an alumina hydrate having a pseudobehmite structure on a base paper. A printed material thus obtained will be described in detail by using FIG. 5, which is a sectional view of electrodes A and B in FIG. 4 taken along segment ab.

Figure 5:
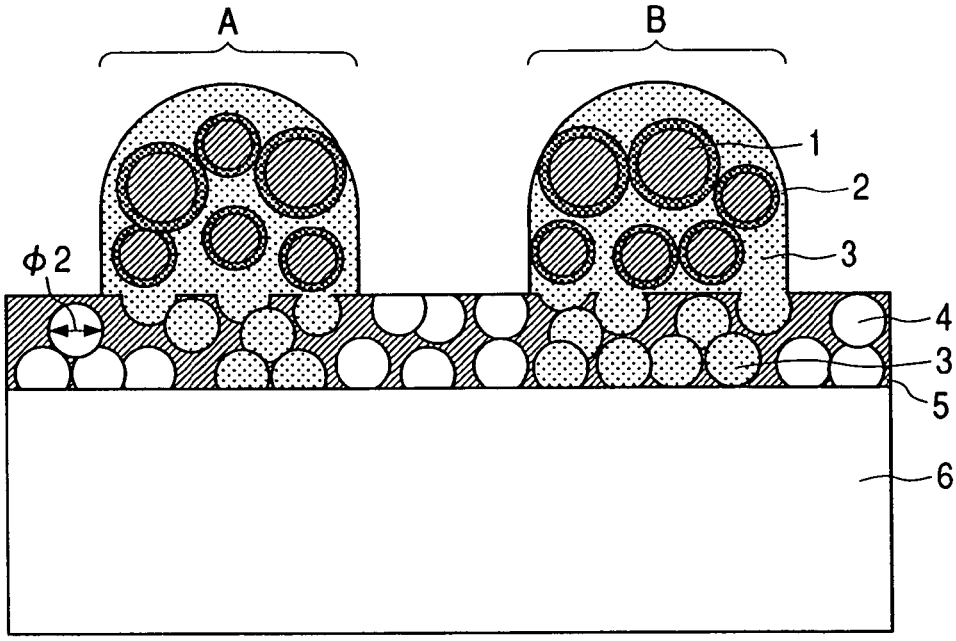
FIG. 5 is a sectional view of electrodes A and B in FIG. 4 taken along segment ab.

A and B in FIG. 5 correspond respectively to electrodes A and B in FIG. 4 immediately after printing by a printer. The numeral 5 denotes an ink receiving layer (porous surface) containing an alumina hydrate having a pseudobehmite structure, which is a porous absorption layer. The pseudobehmite can be manufactured by publicly known methods such as the hydrolysis of aluminum alkoxide and the hydrolysis of sodium aluminate.

In Japanese Patent Application Laid-Open No. 2000-318308 it is disclosed that in the case of a recording medium prepared by using the pseudobehmite by these methods as a coating liquid, the fixing of a dye is better than with conventional recording media, making it possible to obtain picture images of high cooler development properties. $\phi 2$ denotes a pore diameter in the pseudobehmite structure, and the average diameter $\phi 2$ ave calculated by observing the section of the pseudobehmite structure under an electron microscope is about 10 nm.

With this structure, immediately after the silver colloidal solution discharged from the printer head reaches the electrode patterns A and B, the medium (water in this case) penetrates the porous absorption layer just under the patterns and will not spread laterally, so that the electrode patterns can be prevented from being connected to each other. Also, the greater part of the organic substance is separated and removed from the colloidal particles by the penetration of this medium.

Figure 6:
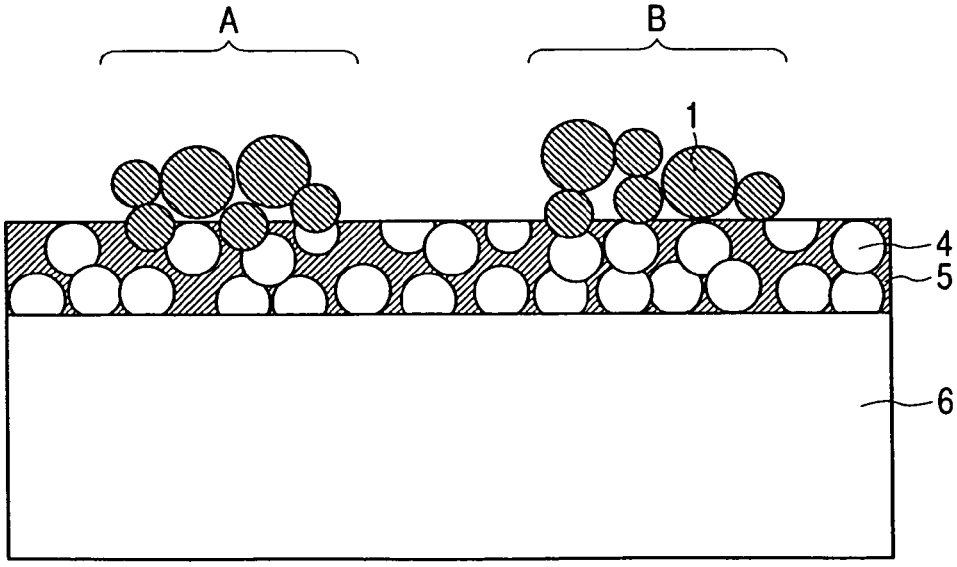
FIG. 6 shows metal colloidal particles after drying by an oven.

FIG. 6 shows the condition of a substrate having the electrode patterns A and B containing the colloid shown in FIG. 5 after drying at 150° C. for 30 minutes by use of an oven. In this figure, the organic substance 2 and liquid medium 3 shown in FIG. 5 do not remain on the porous surface due to absorption into the porous surface, evaporation into the air and the like. Also, the following relationship holds between the average particle diameter of the silver colloidal particles and the average pore diameter of the pseudobehmite layer:

$$\phi 1 \text{ ave} \geqq \phi 2 \text{ ave}$$

Therefore, part of the silver colloidal particles enters the fine pores of the pseudobehmite layer and this is effective in improving the fixability of the electrode patterns as the anchor effect. At the same time, the silver colloidal particles, which are larger than the pores of the pseudobehmite layer, do not move through the pores and, therefore, the particles do not coalesce and do not place the electrodes A and B in conduction.

(Evaluation of Electrical Conductivity)

The specific electric conductivity (electrical conductivity) of the obtained electrically conductive silver film was measured by measuring resistance values by use of a tester. As a result, the resistance value across A-B in FIG. 4 was 6 Ω and the resistance value across B-C was 18 Ω. Thus, the obtained electrically conductive silver film was excellent in electrical conductivity. Under the experimental conditions of the use of the most elementary test device called a tester and of high contact resistance, the resistance values were very small after drying like this and it can be said that the electrically conductive silver film can sufficiently withstand practical applications.

Embodiment 2

Figure 7:
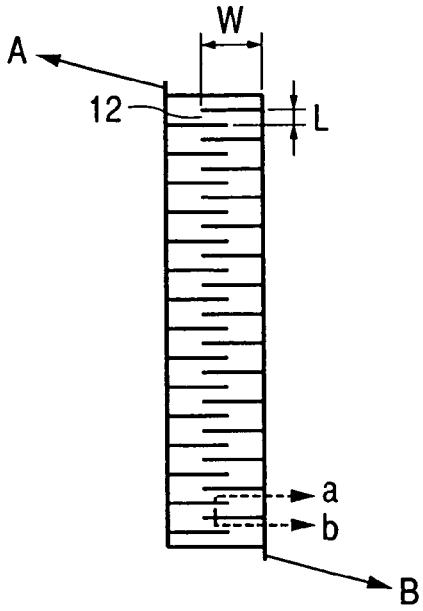
FIG. 7 shows a field effect transistor (FET)

FIG. 7 is a plan view of a field effect transistor (FET) as an electrically conductive member obtained by using the invention. In FIG. 7, A and B each denote a comb type electrode printed by use of the above-described printer. The numeral 12 denotes a water-repellent insulating part, which has been formed beforehand by offset printing before the printing of the electrode A (source) and the electrode B (drain). The material is polyimide, which is "RN-812" made by Nissan Chemical Industries, Ltd. The gap between the electrodes is maintained by this insulating part. Incidentally, the channel length L=100 μm, and the channel width W=4 mm×30. The section cut by segment ab is shown in FIG. 8.

Figure 8:
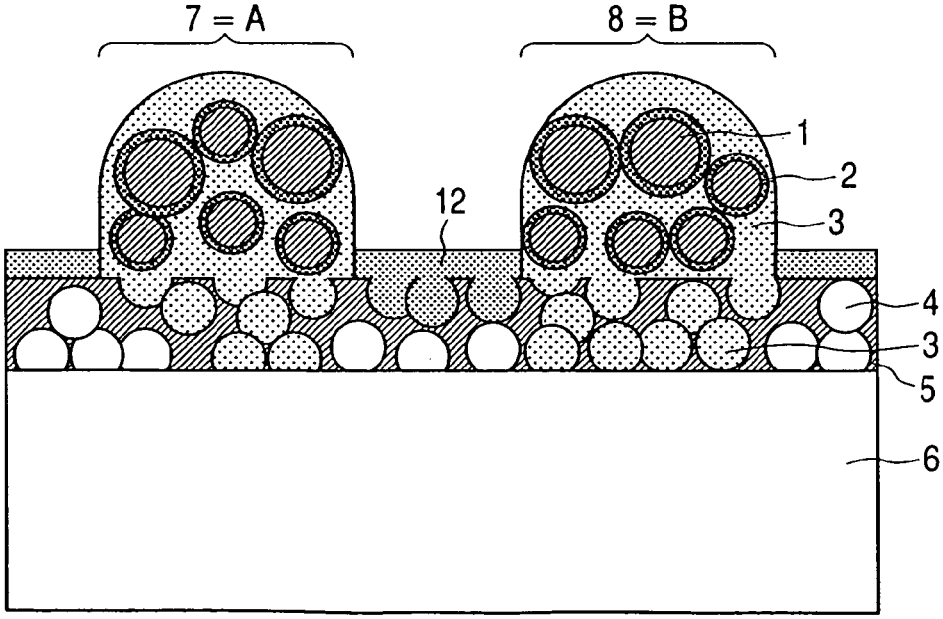
FIG. 8 is a sectional view taken along segment ab of FIG. 7.

In FIG. 8, the numeral 7 denotes the electrode A (source) and the numeral 8 denotes the electrode B (drain). The lower section of the insulating part 12 enters the pores 4 of the porous absorption layer 5 and positively produces the anchor effect. FIG. 8 shows the condition immediately after the printing of the colloidal solution by use of the printer. With this structure, immediately after the silver colloidal solution discharged from the printer head reaches the electrode patterns A and B, the medium (water in this case) and the organic substance dissolved in the medium penetrate the porous absorption layer-just under the patterns and will not spread laterally, so that the electrode patterns are not connected to each other. Furthermore, because the insulating part 12 is water repellent, the gap between the electrodes is determined by the printing accuracy of the insulating part 12 and a channel length of 100 μm could be obtained.

Figure 9:
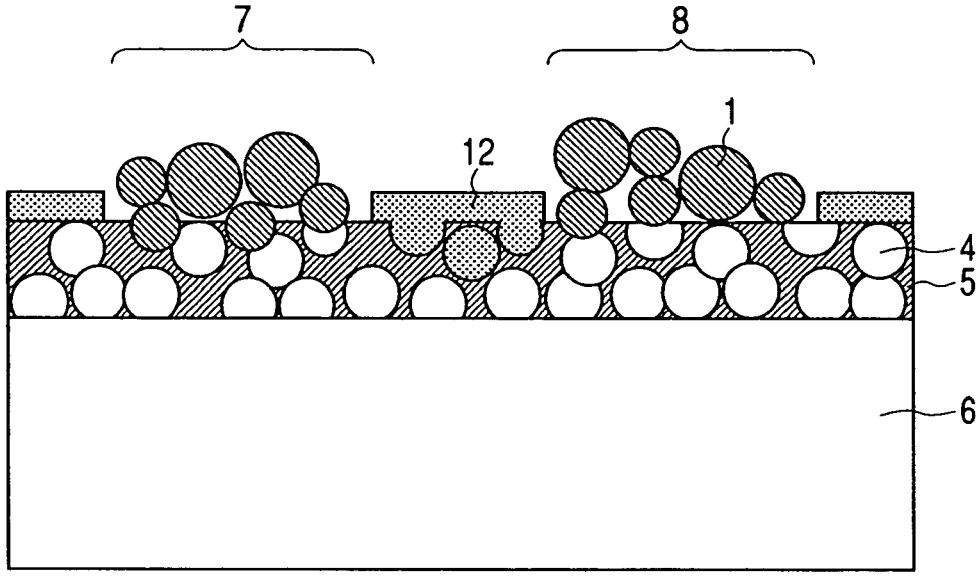
FIG. 9 shows metal colloidal particles after drying by an oven.

FIG. 9 shows the condition of a substrate having the electrode patterns A and B containing the colloid shown in FIG. 8 after drying at 150° C. for 30 minutes by use of an oven. In this figure, the organic substance 2 and liquid medium 3 shown in FIG. 8 do not remain on the porous surface due to absorption into the porous absorption layer or evaporation into the air.

Figure 10:
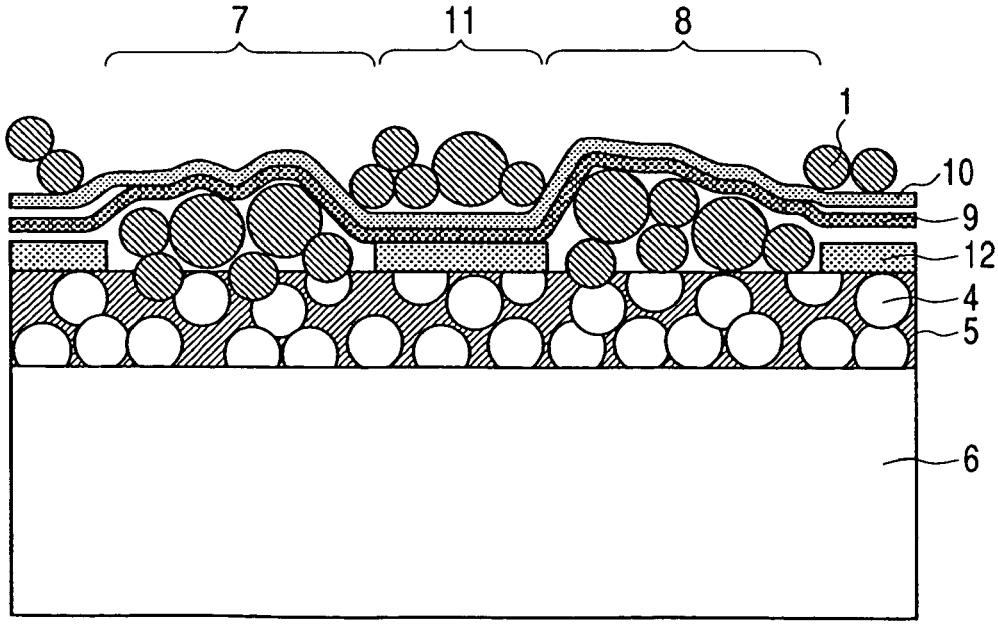
FIG. 10 shows a drawing of an FET.

In FIG. 10, the numeral 9 denotes a deposited organic semiconductor of copper phthalocyanine. The numeral 10 denotes an insulating layer, which was coated with the same "RN-812" of Nissan Chemical Industries, Ltd. as in the insulating part 12. The numeral 11 denotes a gate electrode, which was formed by applying a silver colloidal solution by use of an inkjet printer in the same manner as with the electrodes 7, 8.

Figure 11:
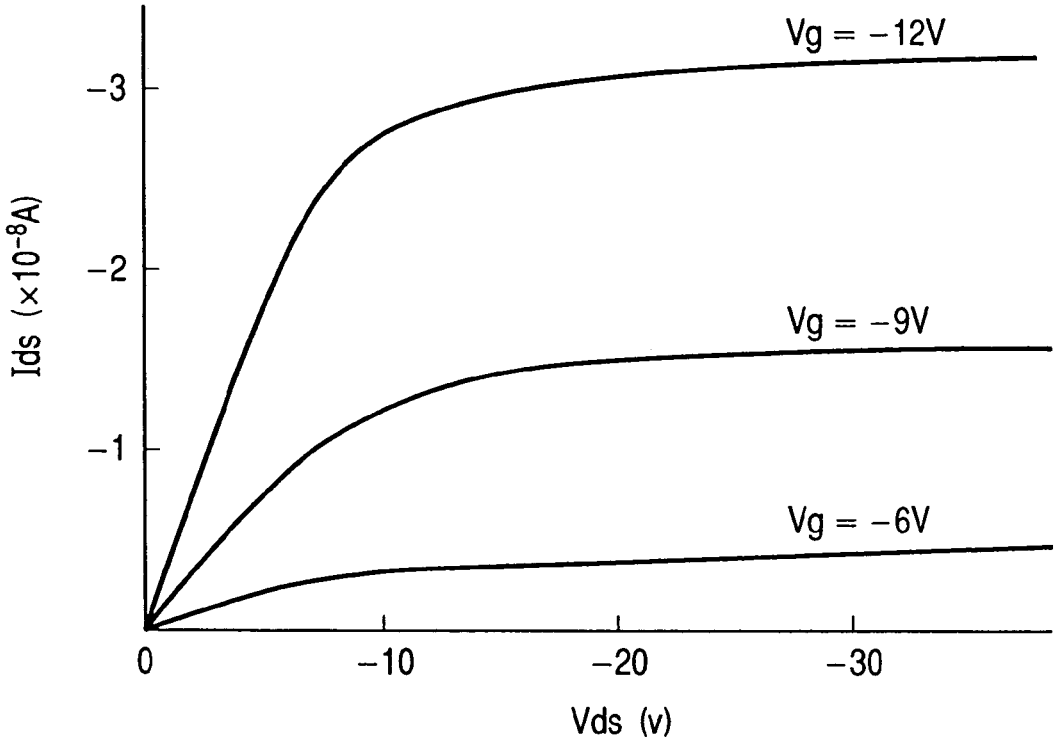
FIG. 11 shows results of measurement of static characteristics of an FET.

Results of the measurement of the static characteristic of the above-described FET (a drain-source current Ids corresponding to a drain-source voltage Vds when a gate voltage Vg is changed in a quasi-static manner) are shown in FIG. 11. As is apparent from the results, this electrically conductive member can be adequately used as an FET if its range of use is limited, although its performance is inferior to a silicon FET.

Embodiment 3

In Embodiment 1, gold, platinum or palladium was used in place of silver and in the same manner as in Embodiment 1, electrically conductive members each having an electrically conductive gold film, an electrically conductive platinum film and an electrically conductive palladium film were formed. The electrically conductive films of the obtained electrically conductive members were evaluated in the same manner as in Embodiment 1. In all of the electrically conductive films, the same excellent effect as in Embodiment 1 was obtained.

Embodiment 4

Electrically conductive members having an electrically conductive silver film were formed in the same manner as in Embodiment 1, with the exception that the spin-coating method, off-set printing or silk printing was used in place of a method that involves using an inkjet recording head as a film forming method for forming a metal colloidal layer. The electrically conductive films were evaluated in the same manner as in Embodiment 1, and the same excellent effect as in Embodiment 1 was obtained.

INDUSTRIAL APPLICABILITY

According to the invention, it is possible to provide an electrically conductive member having a film (thin film) with good properties. In particular, because a film can be formed from a liquid phase and the removal of an organic substance and a solvent can be easily performed by absorption and drying, it is possible to provide an electrically conductive member and an organic semiconductor element that have an electrically conductive metal film excellent in electrical conductivity.

This application claims priority from Japanese Patent Application No. 2002-098299 filed on Apr. 1, 2002, which is hereby incorporated by reference herein.

The invention claimed is:

1. A method of manufacturing an electrically conductive member having an electrically conductive film on a porous substrate, comprising the steps of: (i) applying a colloidal solution of a liquid medium and a colloid, said colloid having a core of a metal colloidal particle and a shell of an organic substance to the substrate, wherein a portion of the metal colloid particles move into pores of the substrate and the liquid medium penetrates into the substrate; and (ii) drying the colloidal solution on the substrate with hot air or infrared radiation to remove the liquid medium and the organic substance, wherein the portion of the metal colloidal particles in the pores of the substrate in step (i) anchors the metal colloidal particles on the substrate in step (ii).

2. The method of manufacturing an electrically conductive member according to claim 1, wherein the metal is silver, gold, platinum or palladium.

3. The method of manufacturing an electrically conductive member according to claim 1, wherein the method includes the step of forming the layer containing the colloid by applying the colloidal solution to the porous surface by spin-coating.

4. The method of manufacturing an electrically conductive member according to claim 1, wherein the method includes the step of forming the layer containing the colloid on the porous surface in a position-selective manner.

5. The method of manufacturing an electrically conductive member according to claim 1 or 4, wherein the layer containing the colloid is formed in a position-selective manner by applying the colloidal solution to the porous surface by inkjet deposition.

6. The method of manufacturing an electrically conductive member according to claim 5, wherein a vicinity of the porous surface, including the surface, has a pseudobehmite structure.

7. The method of manufacturing an electrically conductive member according to claim 6, wherein the following condition is satisfied when it is assumed that an average particle diameter of the metal colloid is Φ1 ave and that an average pore diameter of the porous surface is Φ2 ave:

$$\Phi 1\ \text{ave} \geqq \Phi 2\ \text{ave}.$$

8. An electrically conductive member having an electrically conductive film on a porous surface of a substrate, the electrically conductive film being a dried film of a wet applied film containing colloidal particles, wherein the electrically conductive member has portions in contact with an organic semiconductor and wherein a portion of the colloidal particles are present in the pores of the substrate and anchor the colloidal particles forming the film to the surface of the substrate.

* * * * *